US006206335B1

(12) United States Patent
Huber et al.

(10) Patent No.: US 6,206,335 B1
(45) Date of Patent: Mar. 27, 2001

(54) ADAPTABLE FRAME CARRIER WITH FREEDOM OF MOVEMENT ALONG THREE AXES FOR COUCHES OR SEATS

(76) Inventors: Ulrich Huber, Grünauer Weg 119, Rathenow (DE), 14712; Thomas Götze, Packhofstr. 9, Brandenburg (DE), 14776

( * ) Notice: Subject to any disclaimer, the term of this patent is extended or adjusted under 35 U.S.C. 154(b) by 0 days.

(21) Appl. No.: 09/331,329

(22) PCT Filed: Nov. 25, 1997

(86) PCT No.: PCT/DE97/02823

§ 371 Date: Jun. 18, 1999

§ 102(e) Date: Jun. 18, 1999

(87) PCT Pub. No.: WO98/26694

PCT Pub. Date: Jun. 25, 1998

(30) Foreign Application Priority Data

Dec. 18, 1996 (DE) ..... 196 54 500

(51) Int. Cl.[7] ..... F16M 13/00; A47C 1/02; A47C 1/06; A47C 1/12; A61G 15/00

(52) U.S. Cl. ..... 248/601; 297/313; 297/314

(58) Field of Search ..... 248/601, 604, 248/600, 560, 564, 562; 297/313, 314

(56) References Cited

U.S. PATENT DOCUMENTS 2,132,291 * 10/1938 Fitos ..... 297/314
2,719,571 * 10/1955 Taylor ..... 297/314
4,099,697 * 7/1978 Von Schuckmann ..... 297/314
4,160,553 * 7/1979 Fleischer ..... 248/601
4,294,426 * 10/1981 Fleischer ..... 248/601
5,524,967 * 6/1996 Glockl ..... 297/314
5,590,930 * 1/1997 Glockl ..... 297/313
6,003,944 * 12/1999 Glockl ..... 297/313

* cited by examiner

*Primary Examiner*—Anita M. King
*Assistant Examiner*—Jerome DeLuca
(74) *Attorney, Agent, or Firm*—Cohen, Pontani, Lieberman & Pavane

(57) ABSTRACT

An adaptable frame carrier with triaxial freedom of movement for couches and seats, in which the freedom of movement is achieved in the X-, Y- and Z-direction by a system of elements which can be moved relative to one another and are spring loaded, a connecting element making the moveability between the X-, Y- and Z-direction interdependent. The frame carrier having at least one dome-shaped rolling body (3, 8) which rolls along a pressure-resistant rolling plate (2) in the X- and Y-direction, and two cylinders (6, 7) which slide one into the other and are supported against each other in the Z-direction by a compression spring (4). One of the cylinders (7) which slide one into the other being connected in a spring-loaded and hinged manner to the frame (18) of the couch or seat via a frame connection plate (13).

6 Claims, 3 Drawing Sheets

ADAPTABLE FRAME CARRIER WITH FREEDOM OF MOVEMENT ALONG THREE AXES FOR COUCHES OR SEATS

BACKGROUND OF THE INVENTION

1. Field of the Invention

The invention relates to couches and seats, and more particularly to an adaptable frame carrier with triaxial freedom of movement for a couch or seat, preferably a plurality of frame carriers bearing a structurally stiffened swinging frame and the frame carriers being configured with elements which can be moved relative to one another in order to permit movement in the horizontal plane X-Y, and in the vertical axis being configured by a linearly defined spring mounting in such a manner that the engagement of a connecting element makes the swinging deflection between the horizontal plane and the vertical axis interdependent in such a manner that only definable swinging forces occur.

2. Description of Related Art

Swinging systems which swing freely are designed in DE 43 00 425 C2 as swinging couches which are essentially borne by so-called swinging stands. In this design, the main bearing between the horizontal plane and the vertical axis is configured by a so-called sliding cushion. A complicated lever mechanism is used in order to make the swinging forces proportional. The bearing intersection, in particular, of the sliding cushion renders the functionality dependent on the flexible material of this sliding cushion, which is intended to be a friction-free bearing. Difficult problems arise here in the connection to the base plate described in this document and to the supporting plate of the swinging carrier and to the sliding-cushion element since the bearing is additionally to be designed as a dynamically rigid connection within the swinging system and so the sliding-cushion element has to take on very varied and difficult individual functions and thus has to be regarded as a technically extremely difficult component.

The additional intersections between the individual elements of the lever mechanism and the moveable axial parts in DE 43 00 425 allow the production of additional frictional forces which have a considerable negative effect on the swinging system.

Other designs of free swinging systems are known; however, they do not provide equivalent solutions for a swinging carrier with triaxial freedom of movement with the functional aspects of a low-friction overall swinging system (for example, U.S. Pat. No. 2,529,639).

SUMMARY OF THE INVENTION

The invention is therefore based on the object of providing a frame carrier with triaxial freedom of movement, which frame carrier attains an improvement in the low-friction bearings and with which the difficult design of the above-described embodiment is simplified and in simplifying it the functionality is increased.

The object is achieved in accordance with the features of claim 1. Claims 2 to 5 are expedient developments.

BRIEF DESCRIPTION OF THE DRAWINGS

The invention will be explained using three exemplary embodiments and referring to drawings, in which.

DETAILED DESCRIPTION OF THE PREFERRED EMBODIMENTS

Figure 1:
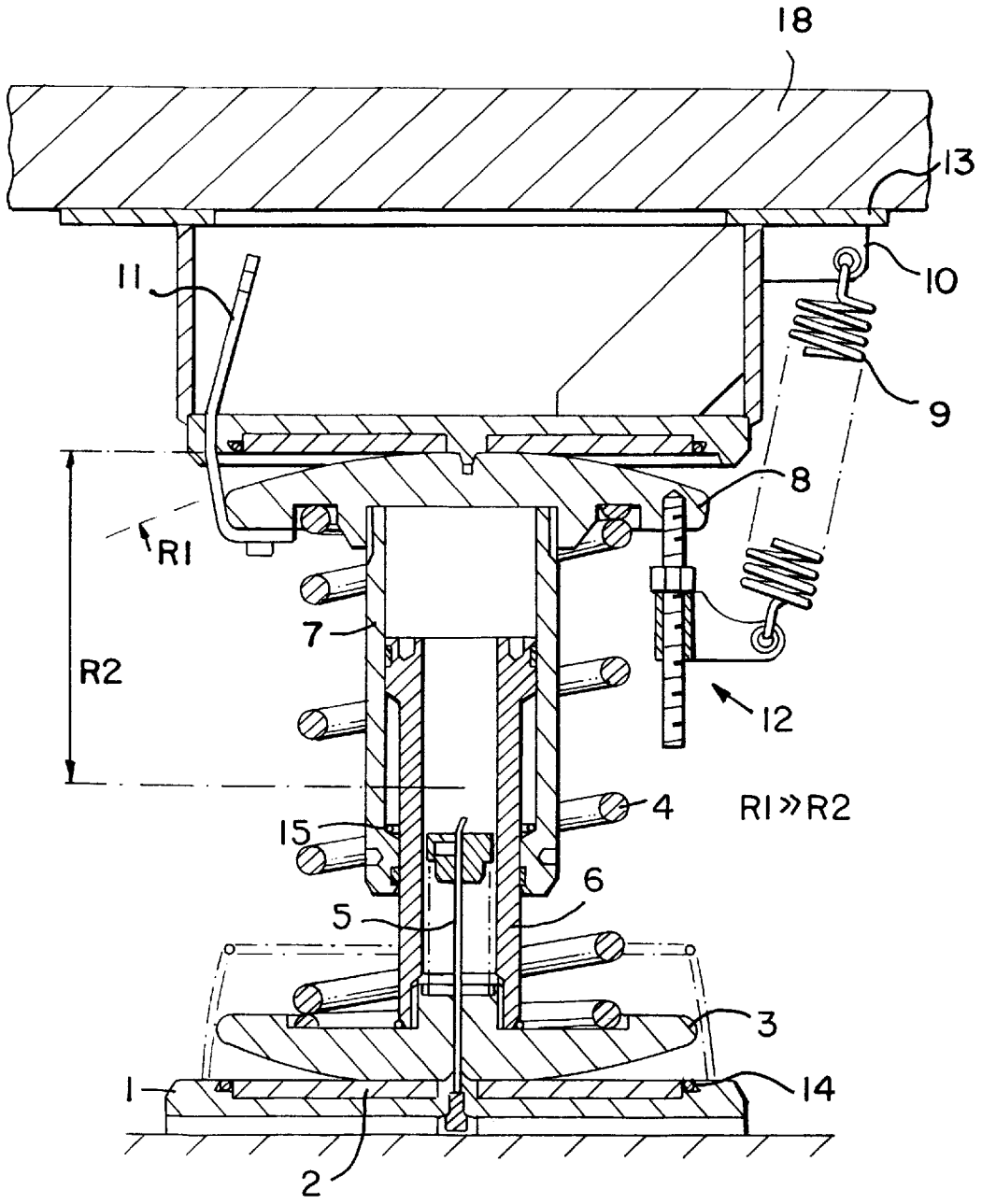
FIG. 1 shows an adaptable frame carrier with triaxial freedom of movement and an external spring system in the Z-axis.

According to FIG. 1, the moveability in the definitive, horizontal frame of movement X-Y is produced by dome-shaped rolling bodies 3 and 8 which can roll along pressure-resistant rolling plates 2 in a low-friction manner. The rolling plate 2 rests on a carrier plate 1. This dome-shaped rolling mounting consists in that the deflection of the frame carrier in the X- or Y-direction causes the frame carrier to execute a lifting displacement H1 in the Z-axis, when the rolling radius R1 of the dome-shaped roller body 3 is selected to be much larger than the semicircular radius R2 of the complete inner rolling element. The lifting displacement H1 can accordingly be represented as a function of the deflection in the X- and Y-direction in interdependence on the dimensional ratio of radii R1 and R2. This design results in the kinematically dynamic effect of the deflection in the horizontal plane causing the production of potential energy due to the swinging frame structure 18 being raised by the lifting displacement H1. This potential energy, as an oscillatory impulse in the entire swinging system, has a positive effect on the harmonic dimensioning of the swing.

Guiding in the Z-axis is designed as a linear guide by means of two cylinders 6, 7 which slide one into another, and consists in that a spring element 4 (FIG. 1) makes the movement stroke in this axis possible. The cylinders 6, 7 being guided with low frictional resistance by means of sliding bearings. A damping ring 15 is provided for damping at maximum deflection in the Z-axis.

The lower carrier plate 1 is connected to the lower, dome-shaped rolling body 3 by a spring-mounted plate support 5. The freedom of movement is thereby retained in this bearing. An oscillation damping ring 14 is placed in the carrier plate 1.

A simple connecting assembly 12, consisting of spring elements 9 which are each coupled to the frame connection 10 or to an adjustable coupling point, causes the swinging forces between the horizontal deflection and the oscillatory stroke in the Z-axis to interdepend on one another. This makes it impossible for any excessively strong oscillations to be produced in the entire oscillatory system comprising a plurality of individual frame carriers which are connected fixedly to a structurally stiffened carrier frame 18 by the frame end plate 13, since a deflection from the zero position causes damping by the connecting assembly 12 which thus simultaneously contributes to stabilizing the oscillation. This connecting assembly 12 is configured in such a manner that there is an adjustment option (for example, changing the spring tension) and the frame carrier therefore obtains a function which can be adapted to the entire oscillatory system in that the adjustment makes it possible for the swinging forces to be changed.

A stop 11 which mechanically restricts the maximum possible oscillatory stroke, is provided on the upper, dome-shaped rolling body 8.

According to the invention, the arrangement described solves the problem of a low-friction bearing and ties in with it the technical effect of connecting the oscillatory energy by raising the frame carriers in the horizontal Z-axis. The intention being for this effect to contribute to stabilizing the swing through the force impulse which is produced. The refinement, which is suitable for manufacturing, of the elements of the Z-axis mounting and of the simple connecting assembly 12 fulfill the functionality required with regard to minimizing the frictional force in the bearings while maintaining the mechanical and technical functionality and the desired oscillatory stability. No technical elements which are difficult to manufacture and which would make conversion of the design into a commercial product difficult have to be used.

Figure 2:
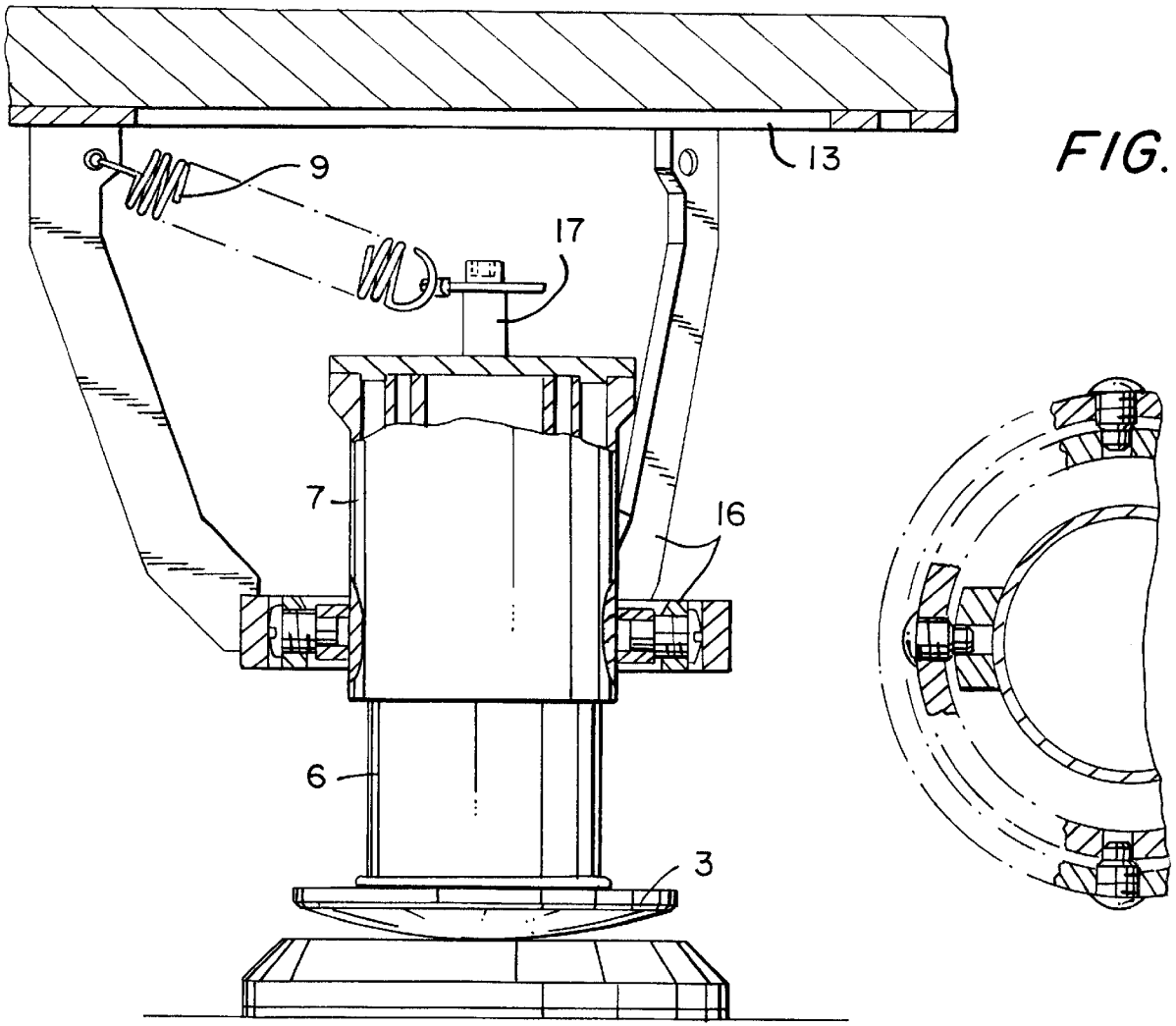
FIG. 2 shows the frame carrier in the refinement with a cardanic mounting.

According to the embodiment in FIG. 2, the dome-shaped mounting 3 described is supplemented by a cardanic mounting 16 which together with a centrally situated connecting assembly 17 essentially produces the described functions of the embodiment according to FIG. 1.

Figure 3:
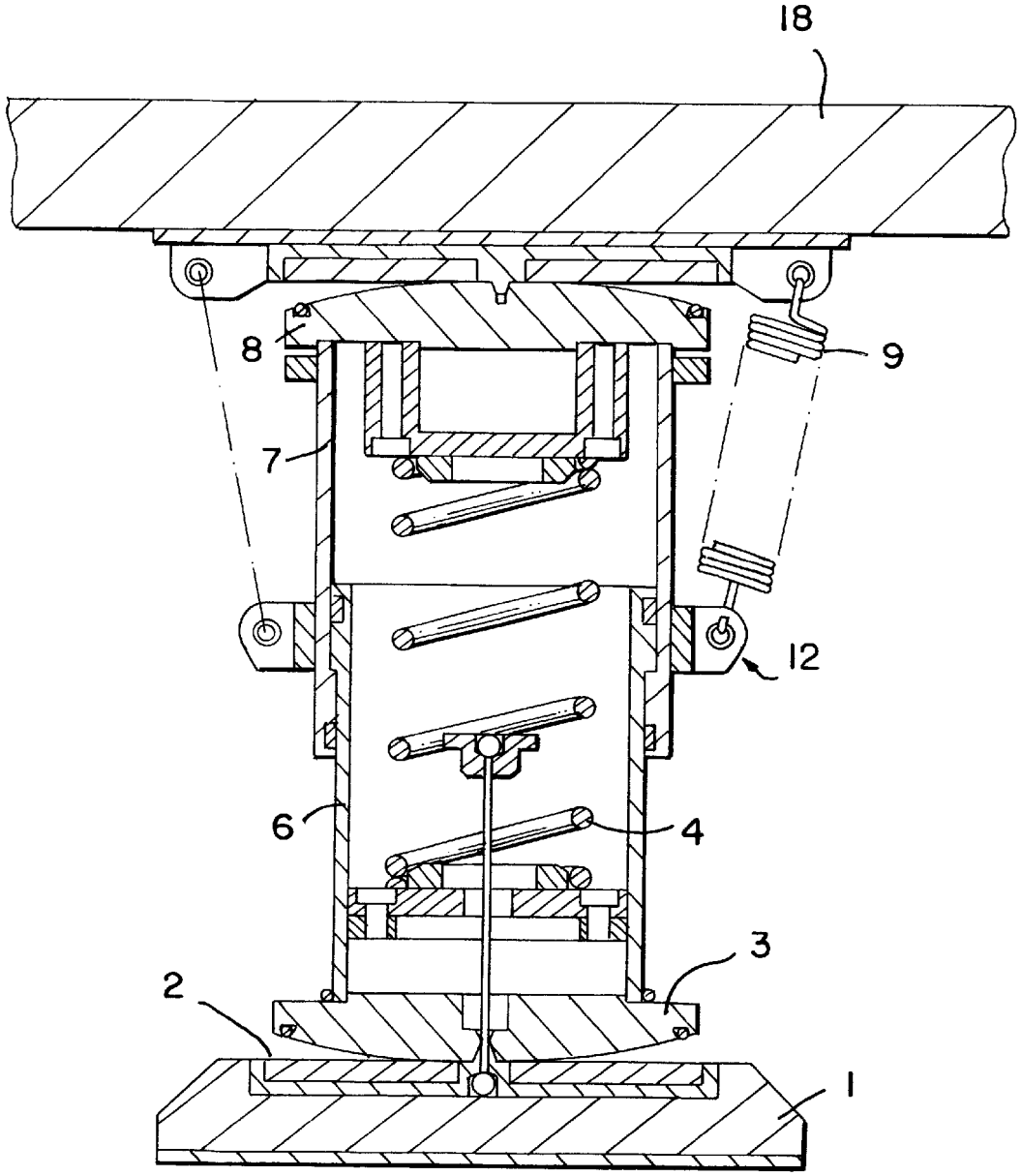
FIG. 3 shows the frame carrier with an internal spring system in the Z-axis.

Furthermore, an embodiment corresponding to FIG. 3 is possible, this embodiment having an internal spring element 4 in the Z-axis and likewise making possible the described functions of the design of FIG. 1.

What is claimed is:

1. An adaptable frame carrier with triaxial freedom of movement for couches and seats, in which the freedom of movement is achieved in the x-, y- and z-direction by a system of spring loaded elements movable relative to one another, the couch or seat having a frame, the adaptable frame carrier comprising:

at least one pressure resistant rolling plate;

at least one dome shaped rolling body having a rolling radius R1 and operably engaging and rolling along said at least one pressure resistant rolling plate in the x- and y-direction;

a frame connection plate operably mounted on the frame;

an upper and a lower cylinder slidably engaging each other, wherein one of said upper and lower cylinders is connected to said frame connection plate in a spring loaded hinged configuration;

a compression spring operably supporting said upper and lower cylinders against each other in a z-direction; and a connecting element connecting at least one of said upper and lower cylinders with said frame connection plate and being operable to make moveability between the x-, y- and z-direction interdependent on one another;

wherein said at least one dome shaped rolling body and said upper and lower cylinders form an inner rolling element having a semicircular radius R2, said rolling radius R1 being greater than said semicircular radius R2.

2. The adaptable frame carrier in accordance with claim 1, wherein said upper and lower slidably engaging cylinders have opposing outer ends, each of said outer ends being respectively provided with one dome shaped rolling body.

3. The adaptable frame carrier in accordance with claim 1, wherein said at least one dome shaped rolling body is provided on said lower cylinder facing away from the couch or seat, and said upper cylinder is movably connected to said frame connection plate via said connecting element, said connecting element comprising:

a cardanic suspension mounting connected at one end to said upper cylinder, and connected at another end to said frame connection plate; and a connecting assembly disposed on said upper cylinder and having springs for connecting said connecting assembly to said frame connection plate.

4. The adaptable frame carrier in accordance with claim 2, wherein said dome shaped rolling bodies are operably mounted so as to be capable of moving on said rolling plates under spring pressure.

5. The frame carrier in accordance with claim 1, wherein said connecting element includes a connecting assembly including springs for connecting said upper cylinder of the frame carrier and said frame connection plate and said spring having an adjustable coupling point.

6. The frame carrier in accordance with claim 1, additionally comprising a stop element for restricting the rolling movement of said dome shaped rolling body.

* * * * *